US008002372B2

(12) United States Patent
Matsuda

(10) Patent No.: US 8,002,372 B2
(45) Date of Patent: Aug. 23, 2011

(54) LIQUID PUMP AND INKJET PRINTER EQUIPPED WITH LIQUID PUMP

(75) Inventor: Masashi Matsuda, Tokyo (JP)

(73) Assignees: Ortek Corporation, Tokyo (JP); Olympus Corporation, Tokyo (JP)

( * ) Notice: Subject to any disclaimer, the term of this patent is extended or adjusted under 35 U.S.C. 154(b) by 663 days.

(21) Appl. No.: 12/002,891

(22) Filed: Dec. 19, 2007

(65) Prior Publication Data

US 2008/0151014 A1 Jun. 26, 2008

(30) Foreign Application Priority Data

Dec. 26, 2006 (JP) ..... 2006-350370

(51) Int. Cl.
*B41J 2/195* (2006.01)

(52) U.S. Cl. ..... 347/7; 347/84; 347/85; 347/86; 347/87; 347/88; 347/89; 347/90; 347/91; 347/92; 347/93; 347/94

(58) Field of Classification Search ..... 347/84–94, 347/7

See application file for complete search history.

(56) References Cited

U.S. PATENT DOCUMENTS 6,554,405 B1 * 4/2003 Ohnishi et al. ..... 347/68
7,083,253 B2 * 8/2006 Kimura et al. ..... 347/29
7,178,911 B2 * 2/2007 Katayama et al. ..... 347/86
7,325,908 B2 * 2/2008 Katoh et al. ..... 347/85
7,380,923 B2 * 6/2008 Matsuda et al. ..... 347/85
7,547,097 B2 * 6/2009 Tsukada et al. ..... 347/85
7,784,923 B2 * 8/2010 Ishizawa et al. ..... 347/85
2005/0068383 A1 * 3/2005 Matsuda et al. ..... 347/85
2006/0082621 A1 * 4/2006 Tsukada et al. ..... 347/85

FOREIGN PATENT DOCUMENTS

JP 2002-307724 A 10/2002

* cited by examiner

*Primary Examiner* — Ryan Lepisto
*Assistant Examiner* — Guy G Anderson
(74) *Attorney, Agent, or Firm* — Holtz, Holtz, Goodman & Chick, PC

(57) ABSTRACT

A long-life pump capable of simultaneously conveying plural liquids and an inkjet printer having the pump are provided. The liquid pump includes: a liquid storage unit having liquid chambers trapping at least two types of liquids with each chamber corresponding to the type of the trapped liquid; a coupling member for connection to each liquid chamber of the liquid storage unit; a pressure adjusting mechanism, connected to the coupling member, for alternately switching between a negative pressure and a positive pressure of an internal pressure of the liquid chamber; an inlet valve capable of passing the liquid to the liquid chamber; an outlet valve discharging the liquid in the liquid chamber; and a pass resistance variable mechanism adjusting an amount of the liquid trapped in the liquid chamber depending on a level of the liquid in the liquid chamber.

18 Claims, 18 Drawing Sheets

LIQUID PUMP AND INKJET PRINTER EQUIPPED WITH LIQUID PUMP

CROSS REFERENCE TO RELATED APPLICATION

This application is based upon and claims the benefit of priority from the prior Japanese Application No. 2006-350370, filed Dec. 26, 2006, the entire contents of which are incorporated herein by reference.

BACKGROUND OF THE INVENTION

1. Field of the Invention

The present invention relates to a liquid pump and an inkjet printer provided with the pump.

2. Description of the Related Art

In the inkjet recording device, it is common to use a liquid pump in supplying, circulating and wasting ink. The liquid pump comes in various types.

Recently, there are increasing tendencies to use a larger number of types of ink for one inkjet recording device to record high quality images.

Therefore, when ink to be used is supplied by a liquid pump, it not only indicates a large device, but also produces a costly device to provide the same number of liquid pump power sources as the number of liquid pumps, that is, the same number of types of ink.

The Japanese Published Patent Application No. 2002-307724 discloses a pump (liquid pump) capable of relatively easily incorporating power sources into one unit.

FIG. 1 shows the outline of an ink system for a printer in the Japanese Published Patent Application No. 2002-307724, and FIG. 2 shows the configuration of the pump according to the same Japanese Published Patent Application No. 2002-307724. As shown in FIG. 1, the ink system is configured by an ink head 301, an ink head recovery unit 78, a subtank 307, an ink pump 331, an ink bag 310*a*, a waste ink absorber 310*b*, and one-way valves 326 and 327 capable of passing ink only when the condition of the pressure is satisfied such that the ink can pass in the direction indicated by the arrow mark shown in FIG. 1.

The ink pump 331 is configured by a motor P13 as a driving source, an ink supply pump unit P16, and a waste ink collection pump unit P18 as shown in FIG. 2.

The ink supply pump unit P16 and the waste ink collection pump unit P18 are provided with a roller P17 for depressing a tube P20. The ink supply pump unit P16 is fixed to a pump shaft P15 directly coupled to the motor P13 such that the pump can rotate in both normal and reverse directions. The waste ink collection pump unit P18 includes a one-way clutch P21, and can rotate only when the motor P13 rotates in the reverse direction.

The pump according to the Japanese Published Patent Application No. 2002-307724 can also be configured by a gear pump etc. in addition to the above-mentioned tube pump.

Thus, when the motor P13 normally rotates, the ink is supplied from the ink bag 310*a* to the subtank 307 through the one-way valve 327. When the motor P13 inversely rotates, the ink is supplied from the subtank 307 to the head 301 through the one-way valve 326, and simultaneously the waste ink in the ink head recovery unit 78 is collected by the waste ink absorber 310*b*.

FIG. 1 is an explanatory view of the ink system about one color of a printer. When the number of colors to be used increases, the number of coupled pump units corresponding to the number of used colors as shown in FIG. 3, thereby successfully using a number of colors with one driving source.

The pump according to the Japanese Published Patent Application No. 2002-307724, one driving source can be used for an increasing number of colors to be used as if the number of pump units logically increased.

However, the pump unit according to the Japanese Published Patent Application No. 2002-307724 is configured by a tube pump and a gear pump, and has the following disadvantages in durability and reliability requested for a recent inkjet recording device.

That is, a tube pump conveys ink by pressing the outside of the tube P20 containing the ink by the roller P17.

Therefore, there is the possibility that the tube P20 is broken, and the tube P20 requires specifically high flexibility and chemical resistance, thereby resulting in a costly pump.

In addition, a gear pump can generate ground powder from a rotating and rubbing gear portion. If the ground powder etc. is mixed with ink, it may cause defective ink jet of the ink head.

SUMMARY OF THE INVENTION

The liquid pump according to the present invention includes: a liquid storage unit having liquid chambers trapping at least two types of liquids with each liquid chamber corresponding to the type of the trapped liquid; a coupling member for connection to each liquid chamber of the liquid storage unit; a pressure adjusting mechanism, connected to the coupling member, for alternately switching between a negative pressure and a positive pressure of the internal pressure of the liquid chamber; an inlet pipe having an inlet valve capable of passing the liquid only in one direction for passing the liquid to the liquid chamber; an outlet pipe having an outlet valve capable of passing the liquid only in one direction for wasting the liquid in the liquid chamber; and a pass resistance variable mechanism for adjusting the amount of the liquid trapped in the liquid chamber depending on the level of the liquid in the liquid chamber.

The inkjet printer according to the present invention includes: at least two ink tanks for containing ink; an image recording unit for recording an image by discharging the ink onto a recording medium; a pump for supplying the ink in the ink tank to the image recording unit. With the configuration, the pump includes: a liquid storage unit having liquid chambers corresponding to the respective ink tanks; a coupling member for connection to each liquid chamber of the liquid storage unit; a pressure adjusting mechanism, connected to the coupling member, for alternately switching between a negative pressure and a positive pressure of the internal pressure of the liquid chamber; an inlet pipe having an inlet valve for passing the ink in the ink tank to the liquid chamber; an outlet pipe having an outlet valve for wasting the ink in the liquid chamber to the image recording unit; and a pass resistance variable mechanism for adjusting the amount of the ink trapped in the liquid chamber depending on the level of the ink in the liquid chamber.

Furthermore, the inkjet printer according to the present invention includes: at least two ink tanks for trapping ink; an image recording unit for recording an image by discharging the ink onto a recording medium; a pump for supplying the ink in the ink tank to the image recording unit.

With the configuration, the pump includes: a liquid storage unit having liquid chambers corresponding to the respective ink tanks; a level detecting mechanism for detecting the level of the ink in the liquid chamber in at least one liquid chamber of the liquid storage unit; a coupling member for connection to each liquid chamber of the liquid storage unit; an airing mechanism for airing the liquid chambers; a pressure adjusting mechanism, connected to the coupling member, for alternately switching between a negative pressure and a positive pressure of the internal pressure of the liquid chamber; a pressure detection unit for detecting the pressure to the liquid chamber of the pressure adjusting mechanism; an inlet pipe having an inlet valve for passing the ink in the ink tank to the liquid chamber only in one direction; an outlet pipe having an outlet valve for wasting the ink in the liquid chamber to the image recording unit only in one direction; a pass resistance variable mechanism for adjusting the amount of the ink trapped in the liquid chamber depending on the level of the ink in the liquid chamber; and a control unit for controlling the airing mechanism according to at least a detection signal of the level detecting mechanism and the pressure detection unit.

DESCRIPTION OF THE PREFERRED EMBODIMENTS

The embodiments of the present invention are described below in detail with reference to the attached drawings.

Figure 1:
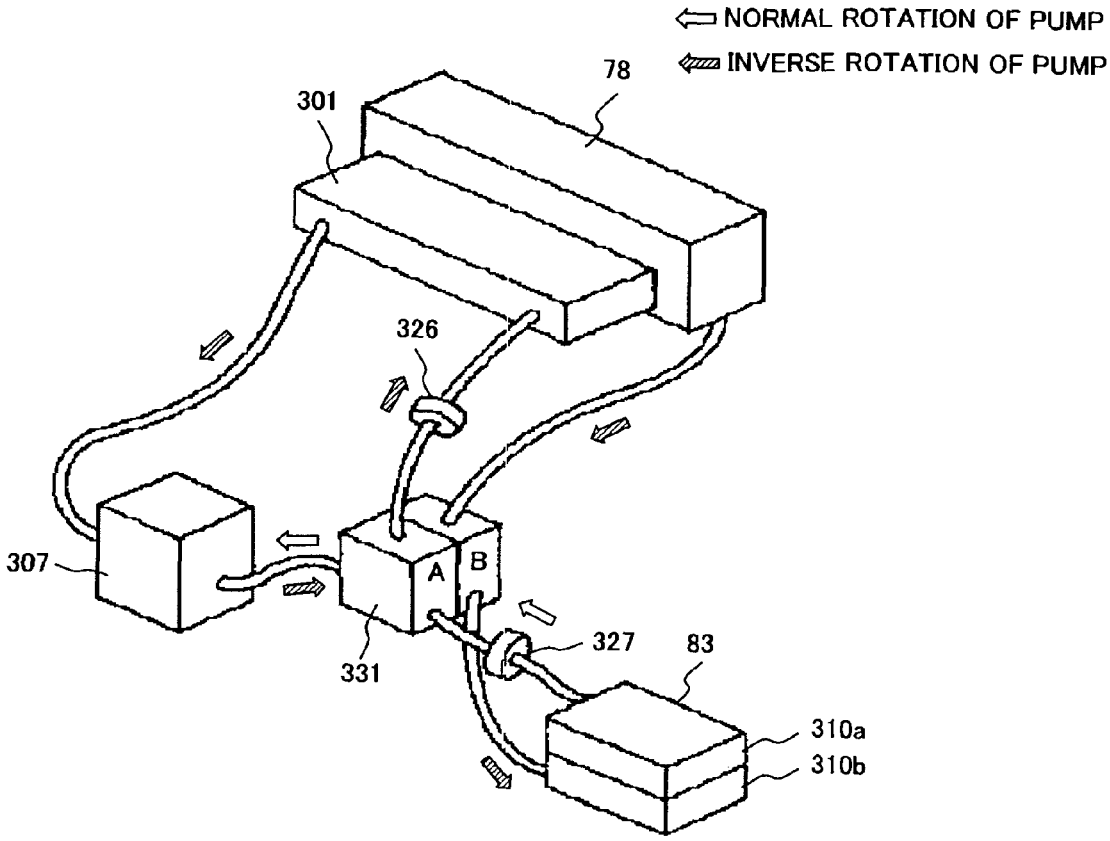
FIG. 1 shows the outline of the ink system in the printer of the prior art.
Figure 2:
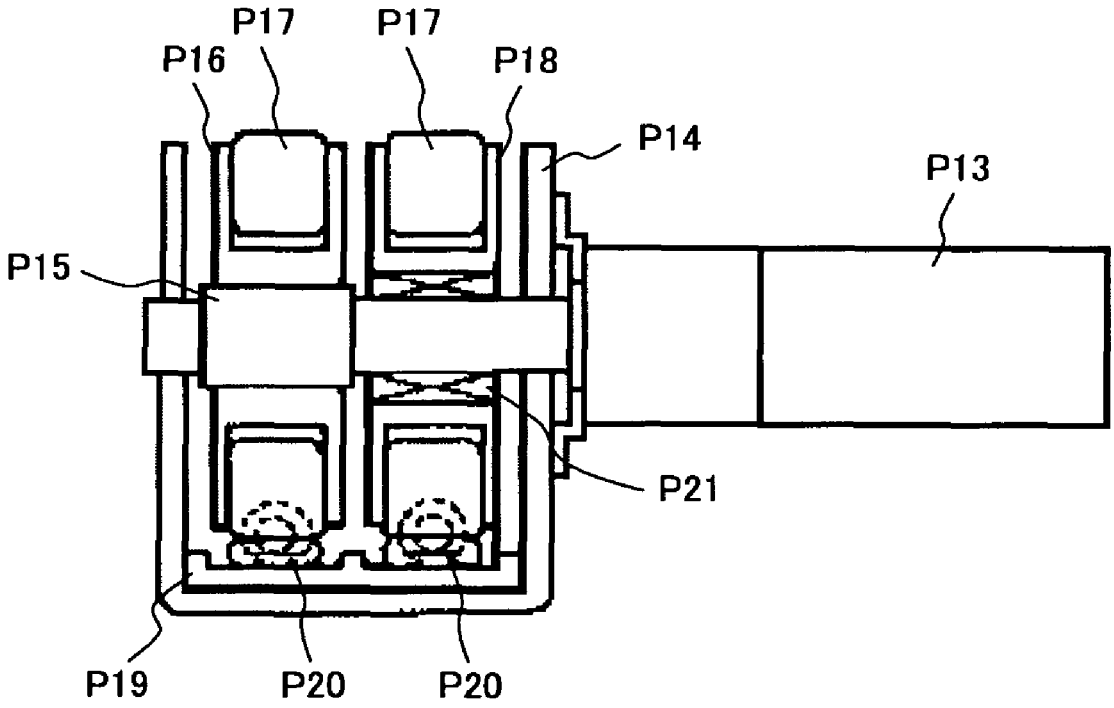
FIG. 2 shows the structure of the pump according to the prior art.
Figure 3:
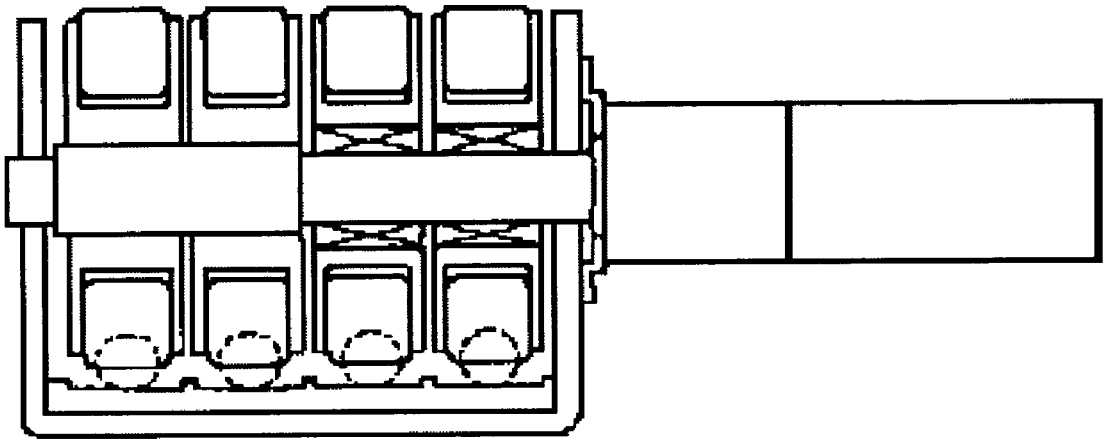
FIG. 3 shows the structure of the pump according to the prior art.
Figure 4:
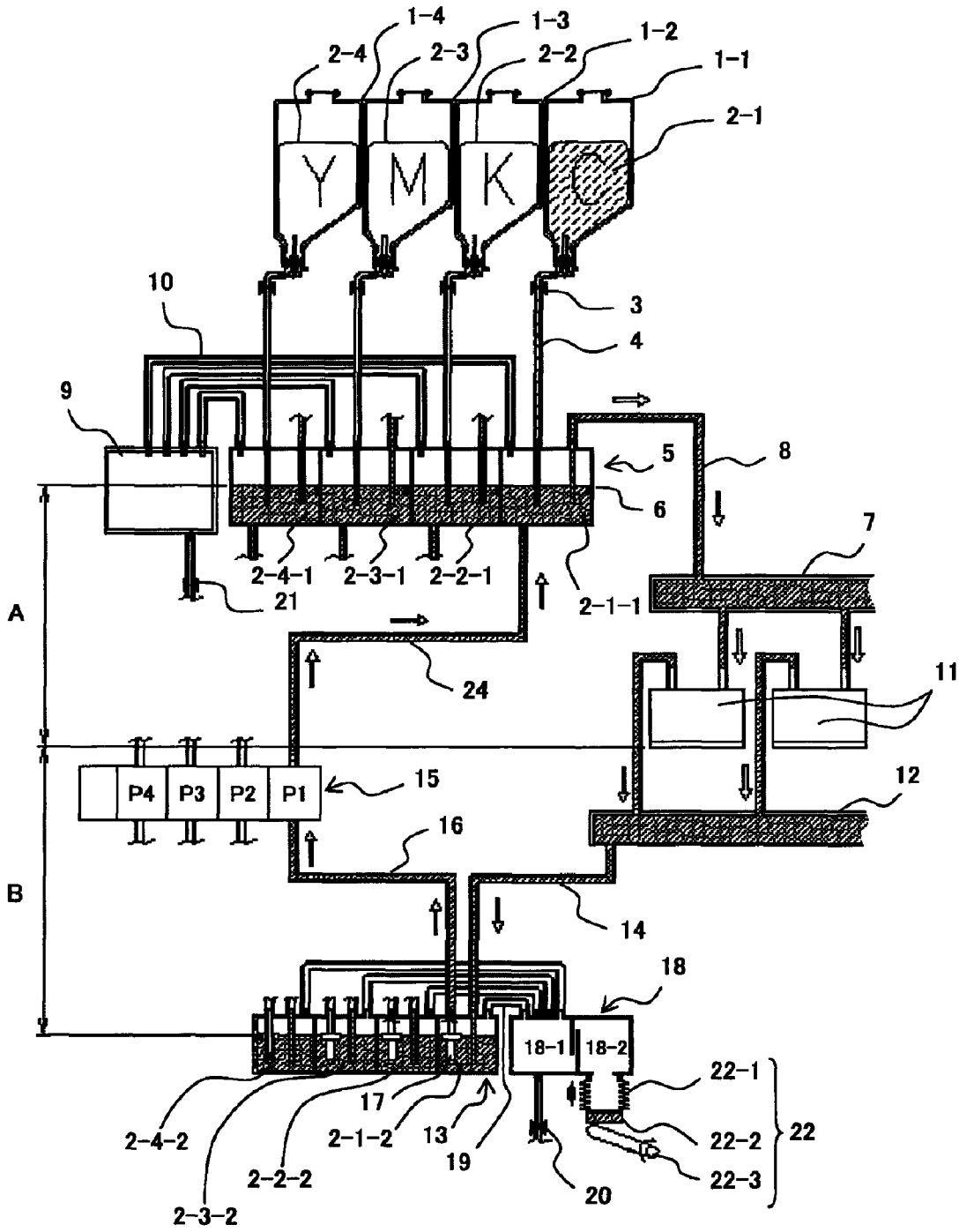
FIG. 4 shows the configuration of the ink path of the inkjet printer according to an embodiment of the present invention.

FIG. 4 shows the configuration of the ink path of the inkjet printer according to an embodiment of the present invention.

The inkjet printer is provided with a plurality of ink tanks 1-1, 1-2, 1-3, and 1-4 respectively containing ink liquids 2-1, 2-2, 2-3, and 2-4 of the respective colors of cyan (C), black (K), magenta (M), and yellow (Y) as a liquid.

Although FIG. 4 shows the ink path for cyan (C) only, but the same holds true with the ink paths of the other colors.

In FIG. 4, an ink path pipe 4 provided with an open valve 3 is connected to the ink tanks 1-1 through 1-4.

The ink path pipe 4 is connected to an upper portion sub-ink-tank 5. The other end portion of the ink path pipe 4 connected to the upper portion sub-ink-tank 5 of the ink path pipe 4 is put in the ink liquids 2-1-1 through 2-4-1 in the upper portion sub-ink-tank 5.

A sensor 6 is mounted in the upper portion sub-ink-tank 5, and detects that the amount of the ink liquids 2-1 through 2-4 supplied from the ink tanks 1-1 through 1-4 has reached a predetermined amount.

A tube 8 is connected to the upper portion sub-ink-tank 5. One end of the tube 8 is put in the ink liquids 2-1-1 through 2-4-1 in the upper portion sub-ink-tank 5, and the other end of the tube 8 is connected to the ink distributor 7.

Furthermore, a tube 10 is connected to the upper portion sub-ink-tank 5. One end of the tube 10 is connected without being put in the ink liquids 2-1-1 through 2-4-1 in the upper portion sub-ink-tank 5, and the other end of the tube 10 is connected to a common air chamber 9.

The common air chamber 9 is provided with an open valve 21 capable of airing the inside of the chamber.

A plurality of ink heads 11 (only two heads are shown in FIG. 4, and the others are omitted) in the inkjet system is connected to the ink distributor 7, thereby forming an image recording unit.

The plurality of ink heads 11 is arranged zigzag in the direction orthogonal to the conveying direction of the recording medium conveyed below the ink head 11 such that the width of the head can be equal to or exceed the width of the recording medium, thereby forming a line head.

The configuration of the line head is not limited to this application, but one or more ink heads 11 can be arranged in the direction orthogonal to the conveying direction of the conveyed recording medium such that the width of the head can be equal to or exceed the width of the recording medium. In the present embodiment, the inkjet printer with a line head is described, but the printer can be a serial type inkjet printer for recording an image by moving the ink head 11 in the width direction of the recording medium.

A plurality of nozzles is formed below the ink heads 11. The ink heads 11 discharge ink liquids from the plurality of nozzles to the recording medium conveyed below, thereby recording an image.

The ink liquids in the plurality of ink heads 11 and not discharged from the nozzles exit the ink heads 11 and are collected by an ink collector 12. Then they pass through a tube 14 and are led to a lower portion sub-ink-tank 13.

The lower portion sub-ink-tank 13 is provided with a tube 16. One end of the tube 16 at which an ink supply amount adjuster 17 is arranged is connected as put in the ink liquids 2-1-2 through 2-4-2 in the lower portion sub-ink-tank 13, and the other end of the tube 16 is connected to a liquid pump 15.

The ink supply amount adjuster 17 self-adjusts the amount of the ink liquid sucked up by the liquid pump 15 depending on the level of the ink of the lower portion sub-ink-tank 13.

Furthermore, the lower portion sub-ink-tank 13 is provided with a tube 19. One end of the tube 19 is connected without being put in the ink liquids 2-1-2 through 2-4-2 in the lower portion sub-ink-tank 13, and the other end of the tube 19 is connected to a pressure adjusting common air chamber 18.

The pressure adjusting common air chamber 18 is configured by a pressure adjusting common air chamber 18-1 and pressure adjusting common air chamber 18-2 in a labyrinth structure.

The pressure adjusting common air chamber 18-1 includes an open valve 20 capable of airing the inside of the pressure adjusting common air chamber 18.

The pressure adjusting common air chamber 18-2 includes a negative pressure adjusting mechanism 22. In an abnormal condition, the ink liquid in the sub-ink-tank 13 does not intrude into the pressure adjusting common air chamber 18-2 by the labyrinth structure.

The negative pressure adjusting mechanism 22 is configured by a bellows unit 22-1, a weight portion 22-2, and an arm 22-3. The arm 22-3 moves up and down the weight portion 22-2 to expand and reduce the bellows unit 22-1. The spring constant of the bellows unit 22-1 is very low. Thus, the pressure in the pressure adjusting common air chamber 18 can be adjusted by expanding or reducing the bellows unit 22-1. That is, since the pressure adjusting common air chamber 18 is connected to the lower portion sub-ink-tank 13 through the tube 19, the pressure in the lower portion sub-ink-tank 13 can be adjusted.

The ink liquids 2-1-2 through 2-4-2 in the lower portion sub-ink-tank 13 are forcibly sucked by the liquid pump 15 through the tube 16, and supplied again to the upper portion sub-ink-tank 5 through a tube 24.

First Embodiment

Figure 5:
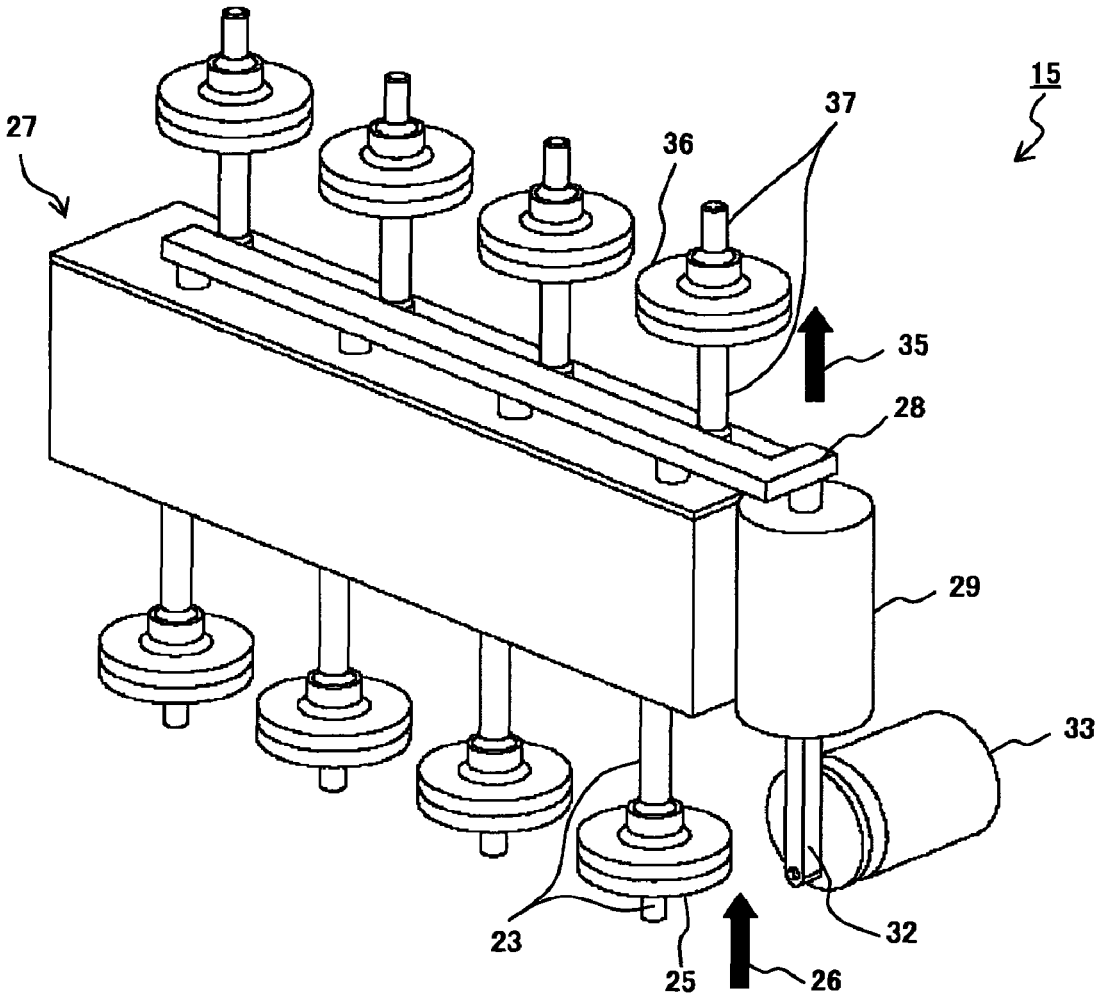
FIG. 5 is a perspective view of the appearance of the pump for forcibly sucking up an ink liquid from a lower portion sub-ink-tank as a first embodiment with the configuration of the ink path of the inkjet printer.

FIG. 5 is a perspective view of the appearance of the liquid pump 15 forcibly sucking the ink liquids 2-1-2 through 2-4-2 from the lower portion sub-ink-tank 13 as the first embodiment with the configuration of the ink path of the inkjet printer.

Figure 6:
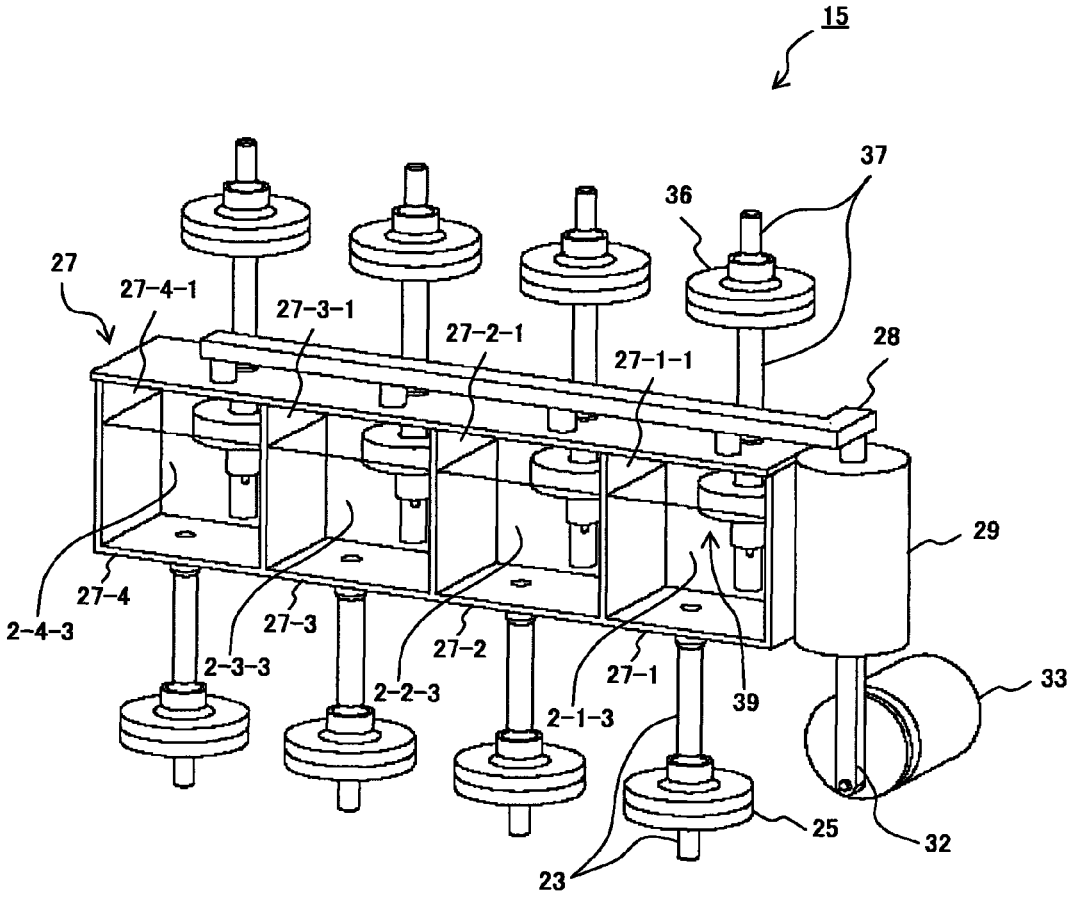
FIG. 6 shows the internal configuration as seen through the front wall of the liquid storage unit shown in FIG. 5 of the pump shown in FIG. 4.

FIG. 6 shows the internal configuration as seen through the front wall of a liquid storage unit 27 in the liquid pump 15 shown in FIG. 5.

Figure 7:
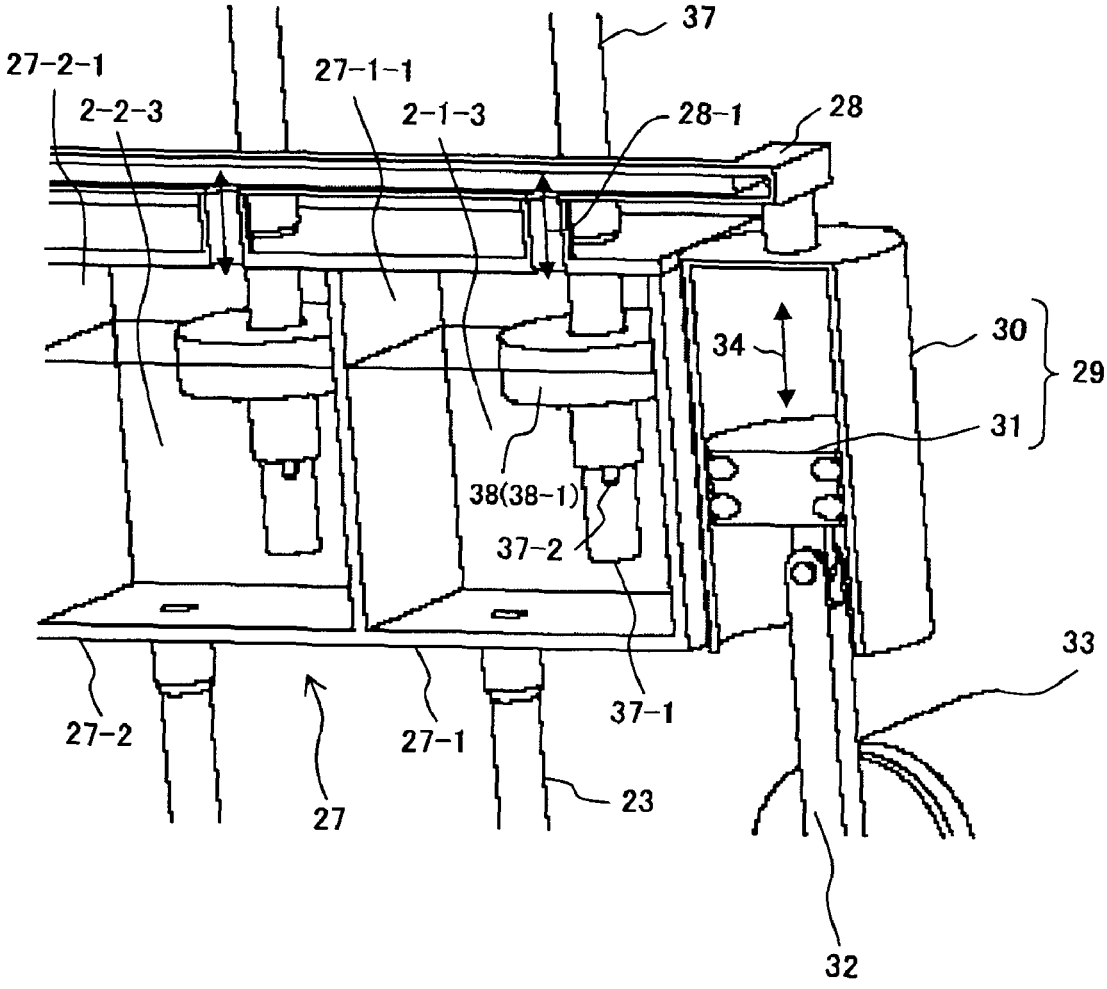
FIG. 7 shows the internal structure by enlarging the piston mechanism and the air chamber coupling member of the pump shown in FIG. 6 as partially cut off for visibility.

FIG. 7 shows the internal structure by enlarging the piston mechanism 29 and the air chamber coupling member 28 shown in FIG. 5 as partially cut off for visibility.

Figure 8:
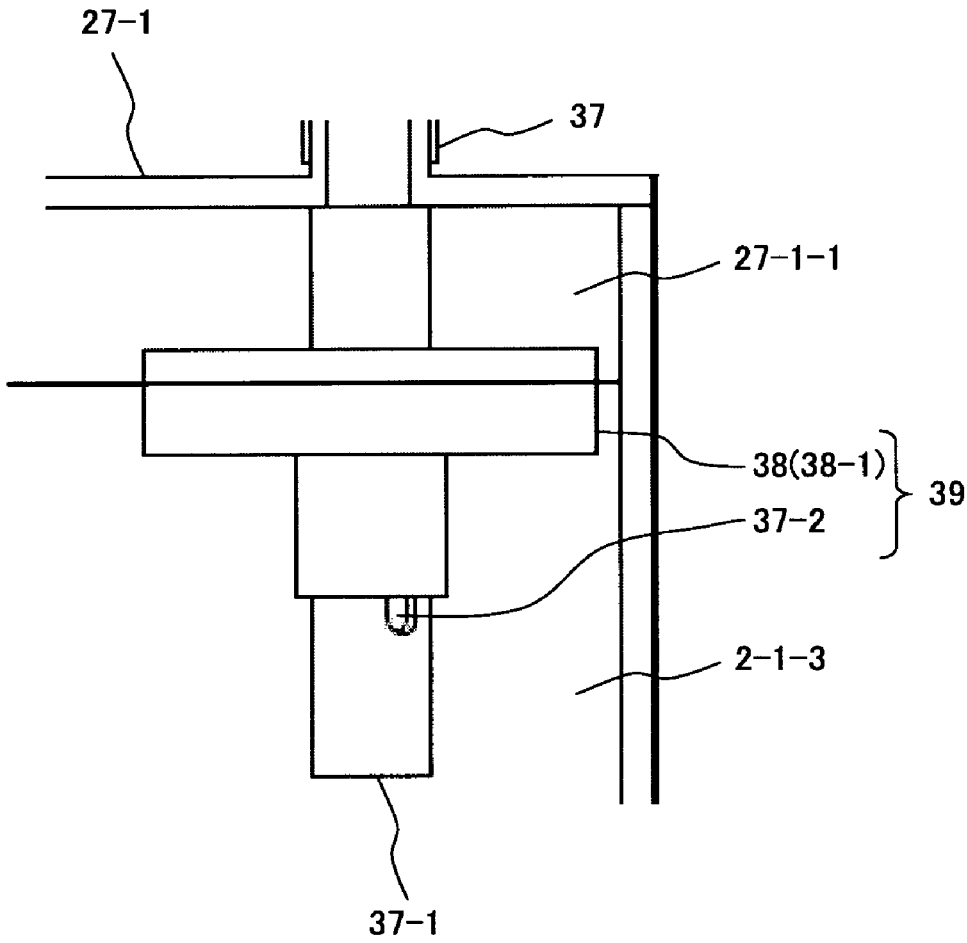
FIG. 8 shows in detail the configuration of the liquid chambers of the liquid storage unit shown in FIG. 7 by enlarging only one of the chambers.

FIG. 8 shows in detail the configuration of the liquid chambers of the liquid storage unit 27 shown in FIG. 6 by enlarging only one of the chambers.

Figure 9:
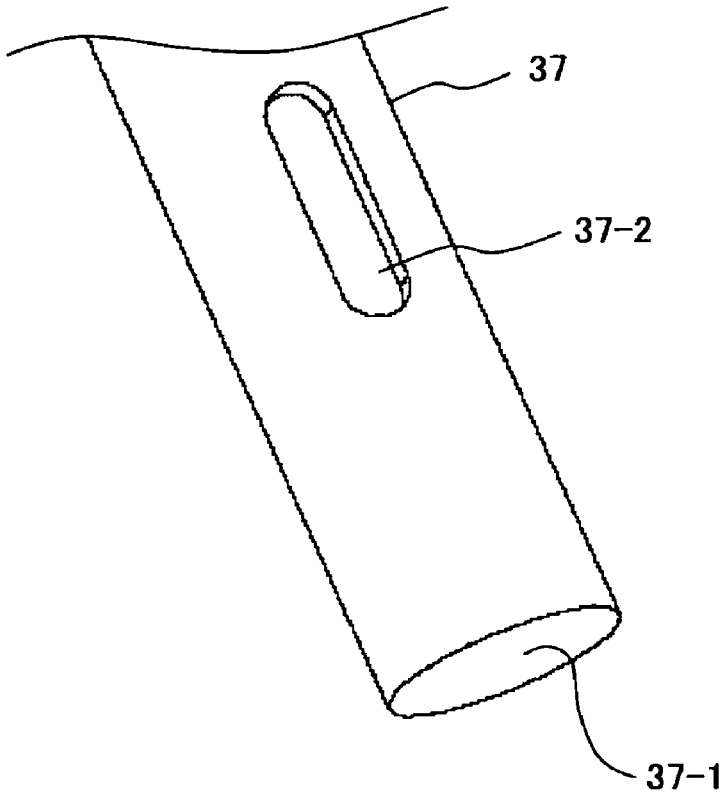
FIG. 9 shows in detail the configuration of the lower end portion of the pipe of the ink level adjusting mechanism containing the ink liquid in the liquid chamber through the outlet valve shown in FIG. 8.

FIG. 9 shows in detail the configuration of the lower end portion of an outlet pipe 37 shown in FIG. 8.

As shown in FIGS. 5 and 6, the liquid pump 15 is provided with the liquid storage unit 27, a level adjusting mechanism 39, an inlet pipe 23, an inlet valve 25 provided for the inlet pipe 23, the outlet pipe 37, an outlet valve 36 provided for the outlet pipe 37, the hollow air chamber coupling member 28 connected to each of the divided liquid chambers in the liquid storage unit 27, the piston mechanism 29 connected to the air chamber coupling member 28, a crank unit 32 and a motor 33 as a driving source for driving the piston mechanism 29.

The piston mechanism 29, the crank unit 32, and the motor 33 configure a pressure adjusting mechanism.

The inlet pipe 23 is connected to the liquid storage unit 27 one end of which is connected to the tube 16, and the other end of which is connected to the liquid storage unit 27 such that the other end can be put in the ink liquid in the liquid storage unit 27.

The inlet valve 25 provided for the inlet pipe 23 is a one-way valve capable of passing the ink liquids 2-1-2 through 2-4-2 sucked from the lower portion sub-ink-tank 13 through the tube 16 only in the direction of an arrow mark 26 shown in FIG. 5. The ink liquid that has passed through the inlet valve 25 is conveyed to the inside of the liquid storage unit 27.

The outlet pipe 37 is connected to the liquid storage unit 27 one end of which is connected to the tube 24, and the other end of which is connected to the liquid storage unit 27 such that the other end can be put in the ink liquid in the liquid storage unit 27.

The other end of the outlet pipe 37 is closed at a lower end portion 37-1 as shown in FIG. 9, and an ink outlet 37-2 is formed as an ink liquid intake on the side.

The outlet valve 36 provided for the outlet pipe 37 is a one-way valve capable of passing the ink liquids 2-1-3 through 2-4-3 in the liquid storage unit 27 only in the direction of an arrow mark 35 shown in FIG. 5.

The ink liquid that has passed through the outlet valve 36 is conveyed to the upper portion sub-ink-tank 5 through the tube 24.

The liquid storage unit 27 includes chambers that are divided for each type of ink liquid as shown in FIG. 6 and form liquid chambers 27-1 through 27-4.

The liquid chambers 27-1 through 27-4 respectively trap the ink liquids 2-1-3 through 2-4-3, and form air chambers 27-1-1 through 27-4-1 above the surface of the ink.

The liquid chambers 27-1 through 27-4 (air chambers 27-1-1 through 27-4-1) are linked by the air chamber coupling member 28 as a coupling member. The air chamber coupling member 28 is linked to the piston mechanism 29 capable of alternately switching the pressure in the inside of the liquid chambers 27-1 through 27-4 of the liquid storage unit 27 between the positive pressure and the negative pressure.

Therefore, a tight structure is guaranteed from the piston mechanism 29 to the liquid chambers 27-1 through 27-4 through the air chamber coupling member 28. That is, since no air is taken from the ambient air, the amount of air in the liquid pump 15 does not change.

The piston mechanism 29 is configured by a cylinder unit 30 and a piston unit 31 as shown in FIG. 7.

The motor 33 drives the crank unit 32 to make a reciprocating motion of the piston unit 31 as indicated by a two-way arrow mark 34.

Thus, the pressure inside the liquid chambers 27-1 through 27-4 of the liquid storage unit 27 can increase or decrease with an equal pressure as indicated by two-way arrow mark 28-1.

That is, when the piston unit 31 is driven upward as indicated by the two-way arrow mark 34, the pressure inside the liquid chambers 27-1 through 27-4 increases through the air chamber coupling member 28. If the piston unit 31 is driven downward as indicated by the two-way arrow mark 34, the pressure inside the liquid chambers 27-1 through 27-4 decreases through the air chamber coupling member 28.

The ink level adjusting mechanism 39 is provided as a pass resistance variable mechanism inside each of the liquid chambers 27-1 through 27-4.

The ink level adjusting mechanism 39 is configured by the ink outlet 37-2 formed on the side of the outlet pipe 37 and a level following member 38 as shown in FIG. 8.

The level following member 38 is a float 38-1 in the present embodiment, and engaged on the outlet pipe 37 such that it can slide on the outlet pipe 37.

FIG. 8 is an enlarged view of the inside of the liquid chamber 27-1, and the same configuration is applied to the other liquid chambers 27-2 through 27-4.

As described above, the other end of the outlet pipe 37 is put in the ink liquid 2-1-3 in the liquid storage unit 27 (liquid chamber 27-1), but practically at least the ink outlet 37-2 is put in the ink liquid 2-1-3.

The ink outlet 37-2 takes in the ink liquid 2-1-3 in the liquid chamber 27-1, and conveys the liquid to the upper portion sub-ink-tank 5.

The float 38-1 floats on the ink liquid 2-1-3 in the liquid chamber 27-1, and moved with the level of the ink.

At this time, the float 38-1 adjusts the amount of the ink liquid 2-1-3 taken in from the ink outlet 37-2 depending on the level of the ink.

That is, when the ink level falls, the float 38-1 follows the level and falls, and covers all or a part of the ink outlet 37-2. Thus, the open area of the ink outlet 37-2 for the ink liquid becomes smaller, and the amount of the ink liquid taken inside the outlet pipe 37 becomes lower.

On the other hand, when the ink level rises, the float 38-1 follows the ink level and rises, the open area of the ink outlet 37-2 for the ink liquid becomes larger than when the ink level falls, and the amount of ink liquid taken in inside the outlet pipe 37 becomes higher.

Thus, the level of the ink in the liquid chamber 27-1 is controlled.

When the piston mechanism 29 shown in FIGS. 5 through 7 applies a pressure to the inside of the liquid chambers 27-1 through 27-4 of the liquid storage unit 27, the ink liquids 2-1-3 through 2-4-3 are taken in from the ink outlet 37-2 to the outlet pipe 37, and pushed out to the upper portion sub-ink-tank 5 as shown in FIG. 4 through the outlet valve 36 and the tube 24.

When the piston mechanism 29 decreases the pressure inside the liquid chambers 27-1 through 27-4 of the liquid storage unit 27, the ink liquids 2-1-2 through 2-4-2 are taken in to the inside of the liquid storage unit 27 through the lower portion sub-ink-tank 13 shown in FIG. 4.

Next, the operation of the ink path of the inkjet printer is described below with reference to FIG. 4 again.

The levels of the ink liquids 2-1-1 through 2-4-1 in the upper portion sub-ink-tank 5 shown in FIG. 4 are monitored by the sensor 6 in the upper portion sub-ink-tank 5.

If the sensor 6 does not detect the levels of the ink liquids 2-1-1 through 2-4-1, the open valve 3 opens, and the ink liquids 2-1 through 2-4 are supplied to the upper portion sub-ink-tank 5 from the ink tanks 1-1 through 1-4.

The movement of the ink liquid at the portion other than from the ink tanks to the upper portion sub-ink-tank is determined such that the liquid can be circulated in the order of, for example, the upper portion sub-ink-tank 5→ink head 11→lower portion sub-ink-tank 13→liquid pump 15→upper portion sub-ink-tank 5 as described above.

Generally, the nozzles of the ink head is kept at a negative pressure. Thus, a surface concave (meniscus) is generated in the inside direction so that a normal printing operation can be performed.

The ink path has the following configuration to apply a negative pressure on the nozzles while circulating the ink liquid as described above.

By keeping a distance A between the nozzles of the ink head 11 and the level of the ink of the upper portion sub-ink-tank 5 above the nozzles and opening the open valve 21, the inside of the upper portion sub-ink-tank 5 is aired. Thus, a predetermined positive pressure is applied to the ink head 11.

Furthermore, a distance B is kept between the ink level of the lower portion sub-ink-tank 13 and the nozzles of the ink head 11, the bellows unit 22-1 and the weight portion 22-2 of the negative pressure adjusting mechanism 22 are lifted by the arm 22-3 with the open valve 20 kept open, and the open valve 20 is closed. Afterwards, the arm 22-3 is lowered, thereby applying a predetermined negative pressure to the inside of the lower portion sub-ink-tank 13.

Thus, the predetermined negative pressure is applied to the ink head 11. The negative pressure in the lower portion sub-ink-tank 13 is variable by changing the weight of the weight portion 22-2.

By striking balance between the negative pressure and the positive pressure by the distance A between the ink head 11 and the ink level of the upper portion sub-ink-tank 5, a predetermined negative pressure can be generated at the nozzles of the ink head 11.

Thus, the ink liquid can pass from the upper portion sub-ink-tank 5 to the lower portion sub-ink-tank 13 through the ink head 11.

The distance B above is set such that a normal meniscus can be formed at the nozzles of the ink head 11 when the open valve 21 is closed and the open valve 20 is opened while the ink liquid is not circulated.

The liquid pump 15 is provided to return the ink liquid passed to the lower portion sub-ink-tank 13 to the upper portion sub-ink-tank 5 again.

At the tip of the supply portion of the lower portion sub-ink-tank 13 of the tube 16 for supplying the ink liquid to the liquid pump 15, the ink supply amount adjuster 17 is provided for decreasing the amount of supply of the ink to the liquid pump 15 by narrowing the supply portion when the ink level of the lower portion sub-ink-tank 13 is lowered, and for increasing the amount of the ink to the liquid pump 15 by enlarging the supply portion when the ink level rises. The ink supply amount adjuster 17 has a configuration similar to that of the ink level adjusting mechanism 39.

The liquid pump 15 is configured as shown in FIGS. 5 through 9. When the liquid chambers 27-1 through 27-4 of the liquid storage unit 27 are negative in pressure by the piston mechanism 29, the ink liquid is sucked by the lower portion sub-ink-tank 13. When the chambers are positive in pressure, the ink liquid is conveyed to the upper portion sub-ink-tank 5.

Although the one-way inlet valves 25 and the one-way outlet valves 36 provided for each of the liquid chambers 27-1 through 27-4 shown in FIGS. 5 and 6 have the same configurations when the operation above is repeated, there is more or less a difference between the amount of ink sucked when the pressure inside each of the liquid chambers 27-1 through 27-4 is kept at a predetermined negative pressure and the amount of ink discharged when a predetermined positive pressure is maintained in each of the liquid chambers 27-2 through 27-4 from a minute difference in a resistance value.

Thus, when the event of a difference in amount of ink passed to or discharged from the liquid storage unit 27 occurs continuously for the liquid storage unit 27, the ink level of each liquid chamber of the liquid storage unit 27 is high for a certain color while it is low for another color. If the condition continues, there is the possibility that a color is mixed with another color through the air chamber coupling member 28.

To avoid the problem, the ink level adjusting mechanism 39 as shown in FIG. 8 is provided in each liquid chamber of the liquid storage unit 27.

Thus, when the ink level rises, the float 38-1 follows the level and rises, and the outlet pipe 37 is enlarged, thereby increasing the amount of ink to be discharged.

On the other hand, when the ink level is lowered, the float 38-1 follows the level and falls, and the outlet pipe 37 is narrowed, thereby decreasing the amount of ink to be discharged.

By the ink level adjusting mechanism 39 provided for all the liquid chambers 27-1 through 27-4 of the liquid storage unit 27, the ink level in each liquid chamber is maintained at the same level regardless of the characteristics of the inlet valve 25 and the outlet valve 36.

At this time, since the amount of air in the liquid pump 15 is fixed, the pump can be operated while maintaining the same ink level in the liquid chambers 27-1 through 27-4.

With the above-mentioned configuration, provided can be a long-life liquid pump capable of simultaneously supplying ink of various colors by one pressure adjusting mechanism.

The present invention is not limited to the above-mentioned embodiment. Some variation examples are described below.

VARIATION EXAMPLE 1 OF THE FIRST EMBODIMENT

Figure 10:
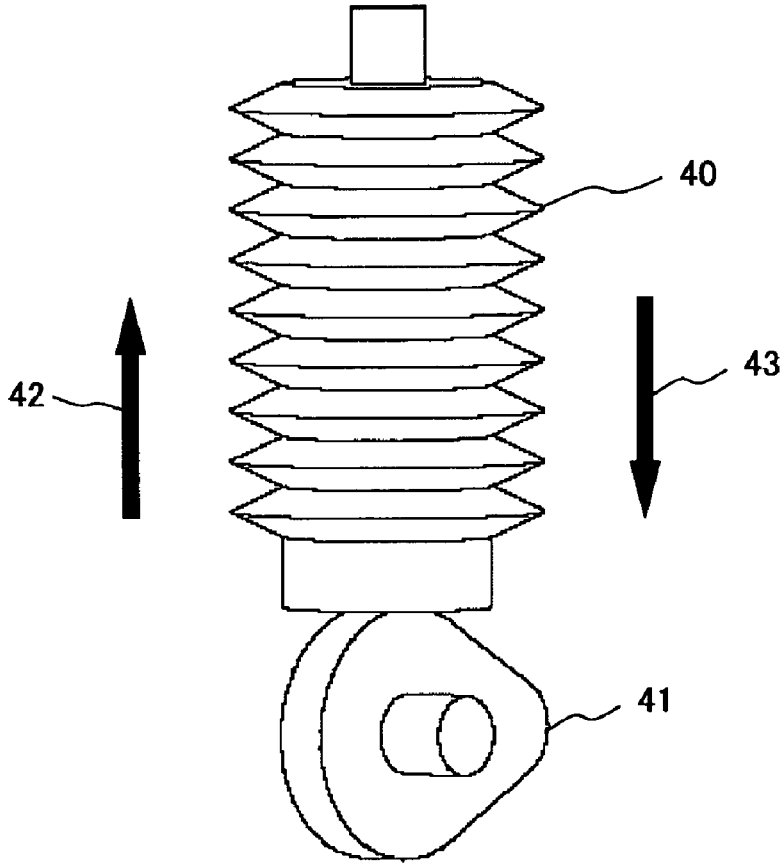
FIG. 10 shows another example of the pressure adjusting mechanism as a variation example 1 according to the first embodiment.

FIG. 10 shows another example of the pressure adjusting mechanism shown in FIGS. 7 and 8 as a variation example 1 of the first embodiment. The pressure adjusting mechanism according to this example is configured by a bellows 40, a cam 41 and a motor not shown in the attached drawings as the driving source.

By driving the cam 41 by the motor not shown in the attached drawings, the bellows 40 is lifted in the direction of an arrow mark 42. After the passage of the cam, the bellows return in the direction of an arrow mark 43 by the elasticity of the bellows 40.

In this operation, the same positive or negative pressure can be applied to the liquid chambers 27-1 through 27-4.

VARIATION EXAMPLE 2 OF THE FIRST EMBODIMENT

Figure 11B:
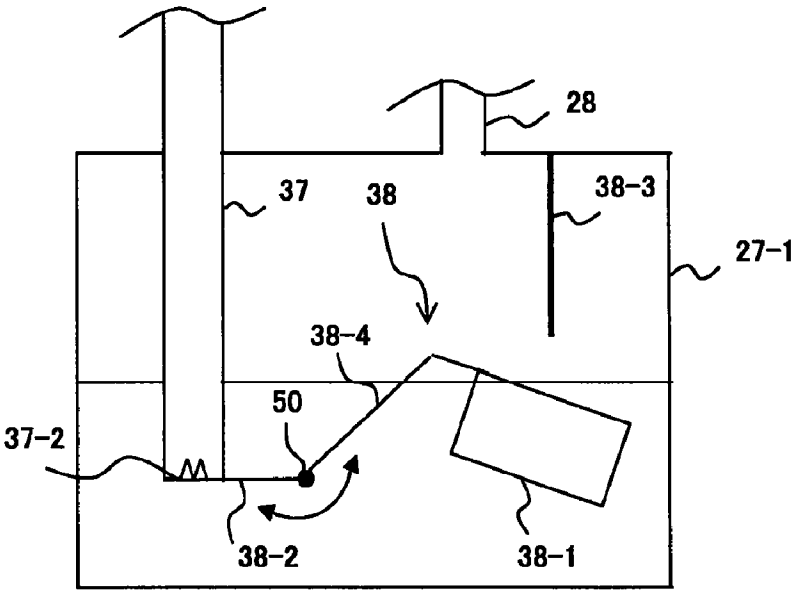
FIG. 11B is a view (2) of the configuration and the operation of another example of the level adjusting mechanism as a variation example 2 according to the first example.
Figure 11A:
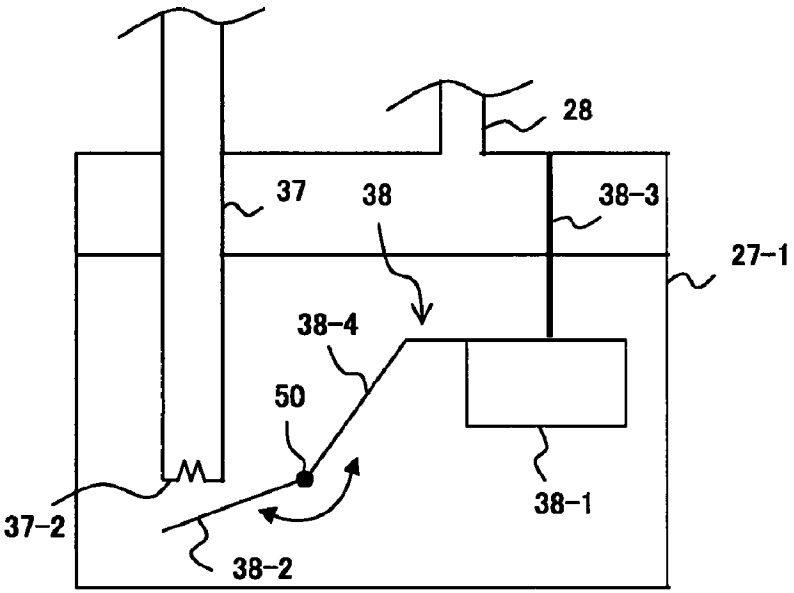
FIG. 11A is a view (1) of the configuration and the operation of another example of the level adjusting mechanism as a variation example 2 according to the first example.

FIGS. 11A and 11B show the configuration and operation of another example of the ink level adjusting mechanism as the variation example of the first embodiment.

In the first embodiment described above, the ink level adjusting mechanism 39 is configured by the float 38-1 as the level following member 38 and the ink outlet 37-2 provided at the side portion of the outlet pipe 37 as the ink liquid intake.

In the present variation example, the ink level adjusting mechanism 39 has the level following member 38 configured by the float 38-1, an outlet cover 38-2, a float topper 38-3, and a rotation arm 38-4, and the ink liquid intake (ink outlet 37-2) is provided at the lower end portion 37-1 of the outlet pipe 37, which is different from the configuration according to the first embodiment.

The float 38-1 moves up and down by the fluctuation of the ink level. In cooperation with the up and down operation of the float 38-1, the rotation arm 38-4 rotates like a seesaw on a rotation support shaft 50 as a fulcrum. The outlet cover 38-2 is formed on the other end portion opposite the connection portion between the rotation arm 38-4 and the float 38-1.

When the ink level is high as shown in FIG. 11A, the float 38-1 touches the float topper 38-3 and is prevented from floating.

In this state, the distance between the ink outlet 37-2 of the outlet pipe 37 and the outlet cover 38-2 is the longest and the amount of discharge of the ink liquid is large.

When the ink level drops, distance between the ink outlet 37-2 of the outlet pipe 37 and the outlet cover 38-2 is shortened, thereby decreasing the amount of discharge.

As shown in FIG. 11B, when the ink level largely falls, the float 38-1 drops to the lowest position. In cooperation with the float, the outlet cover 38-2 rotates to the highest position, and operates such that the cover substantially closes the ink outlet 37-2 of the outlet pipe 37.

When the outlet cover 38-2 rotates up to the highest position, it does not completely close the ink outlet 37-2 by the effect of a groove provided in the ink outlet 37-2.

Thus, although the outlet cover 38-2 closes the ink outlet 37-2, a small amount of ink liquid can be fed to the upper portion sub-ink-tank 5 through the groove.

That is, when the ink level rises, the distance between the ink outlet 37-2 of the outlet pipe 37 and the outlet cover 38-2 is expanded, and the amount of discharge increases. When the ink level falls, the distance between the ink outlet 37-2 of the outlet pipe 37 and the outlet cover 38-2 is shortened, and the amount of discharge decreases, thereby maintaining the operation similar to the operation according to the first embodiment.

VARIATION EXAMPLE 3 OF THE FIRST EMBODIMENT

Figure 12B:
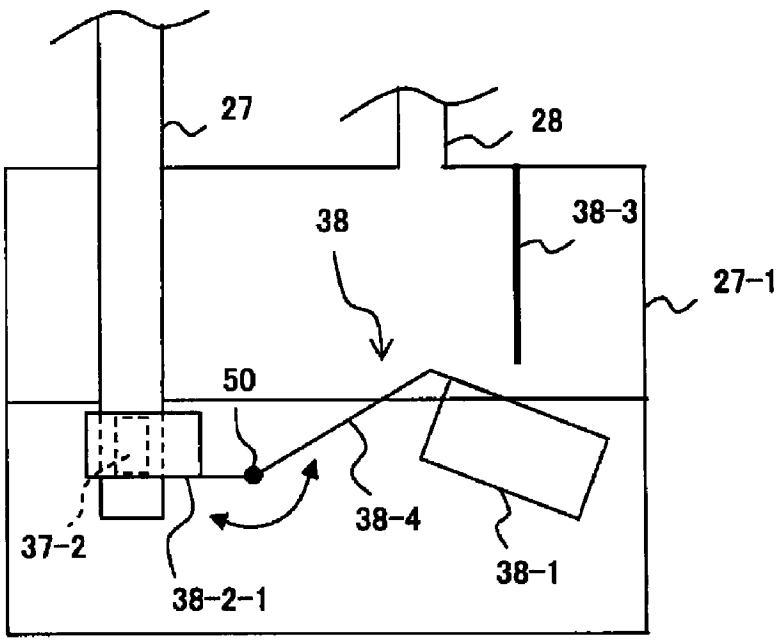
FIG. 12B is a view (2) of the configuration and the operation of a further example of the level adjusting mechanism as a variation example 3 according to the first example.
Figure 12A:
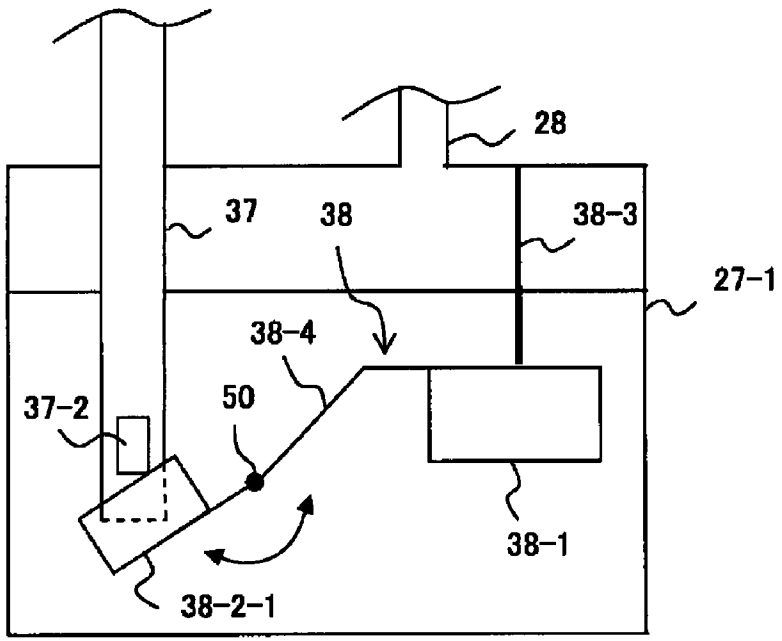
FIG. 12A is a view (1) of the configuration and the operation of a further example of the level adjusting mechanism as a variation example 3 according to the first example.

FIGS. 12A and 12B show the configurations and operations of other examples of the level adjusting mechanism as the variation example 3 according to the first embodiment.

The ink level adjusting mechanism according to the present variation example has the ink outlet 37-2 on the side of the outlet pipe 37 as the ink liquid intake as with the first embodiment as shown in FIGS. 12A and 12B.

As in the variation example 2, the level following member 38 is provided with the float 38-1, the float stopper 38-3, and the rotation arm 38-4.

However, in the present variation example, an outlet cover unit 38-2-1 is formed in the vertical direction at the end portion opposite the connection unit to the float 38-1 of the rotation arm 38-4.

As shown in FIG. 12A, when the ink level is high, the float 38-1 touches the float stopper 38-3 and is prevented from floating.

In this state, the ink outlet 37-2 of the outlet pipe 37 is totally released from the outlet cover unit 38-2-1, and the amount of discharge of the ink liquid is large.

When the ink level falls, the outlet pipe ink outlet 37 of the outlet pipe 37 is gradually closed by the outlet cover unit 38-2-1, and the amount of discharge of ink decreases.

As shown in FIG. 12B, when the ink level largely falls, the float 38-1 drops to the lowest position. In cooperation with the float, the outlet cover unit 38-2-1 rotates to the highest position, and operates such that the cover substantially closes the ink outlet 37 of the outlet pipe 37.

That is, when the ink level rises, and the amount of discharge of ink increases by the outlet cover unit 38-2-1 moving in the direction of opening the ink outlet 37-2 of the outlet pipe 37. When the ink level falls, the outlet cover unit 38-2-1 moves in the direction of closing the ink outlet 37-2 of the outlet pipe 37, and the amount of discharge decreases, thereby maintaining the operation similar to the operation according to the first embodiment.

Second Embodiment

To use the liquid pump with the above-mentioned configuration for a long period, it is necessary to consider the case in which the air in the liquid chambers 27-1 through 27-4 is mixed into the ink and the amount of air of the liquid chambers 27-1 through 27-4 gradually decreases, or the case in which the air mixed into the ink comes out and the amount of air in the liquid chambers 27-1 through 27-4 gradually increases.

In the normal condition, in this case, a level detecting mechanism is provided for all liquid chambers, and the ink level is controlled by monitoring whether the level of the ink is normal.

However, in the present invention, since the level of the ink of each of the liquid chambers 27-1 through 27-4 is configured as the same level, one of the ink levels of the liquid chambers 27-1 through 27-4 is monitored, thereby successfully monitoring the ink levels of all liquid chambers.

The configuration is described below as the second embodiment.

Figure 13:
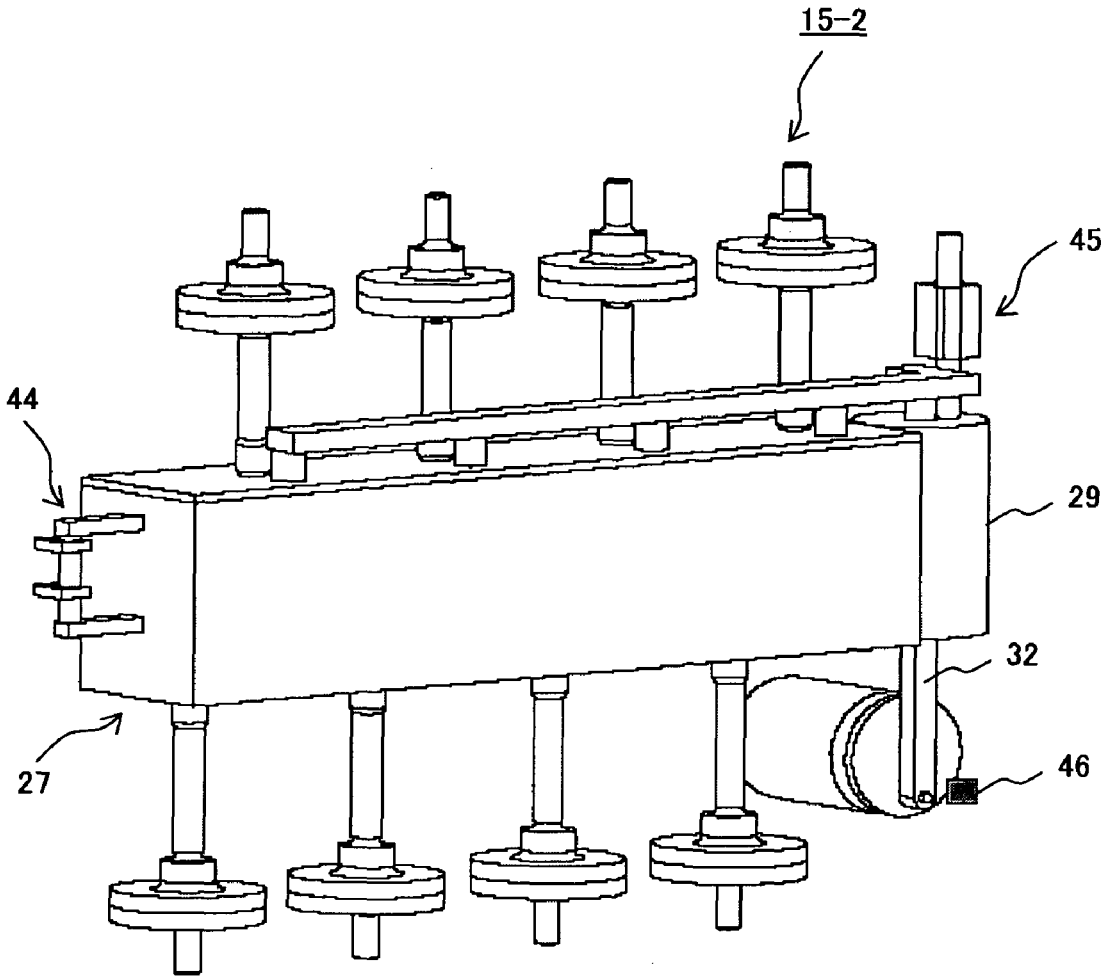
FIG. 13 is a perspective view of the configuration of the liquid pump according to the second embodiment.

FIG. 13 is a perspective view of the configuration of the liquid pump according to the second embodiment. As shown in FIG. 13, a liquid pump 15-2 according to the present embodiment is provided with an ink level detecting mechanism 44 for detecting the level of the ink liquid in a liquid chamber, an electromagnetic valve 45 as an airing mechanism for airing in a liquid chamber, and a crank position sensor 46 as a pressure detection unit for detecting the pressure in the liquid chamber. Other configurations are the same as those according to the first embodiment.

Figure 14:
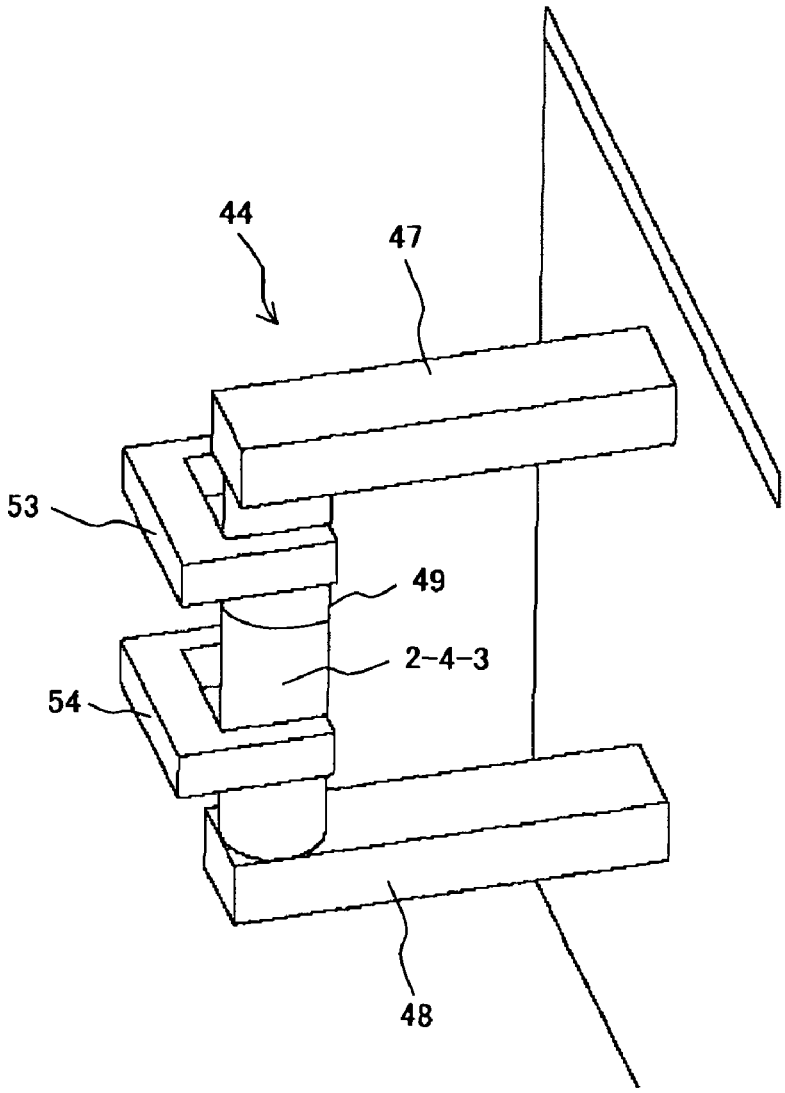
FIG. 14 is an enlarged view of the configuration of the sensor unit of the liquid pump according to the second embodiment.

FIG. 14 is a view obtained by extending the configuration of the ink level detecting mechanism 44 of the liquid pump according to the second embodiment. In the present embodiment, the liquid chamber 27-4 of the liquid storage unit 27 is provided with the ink level detecting mechanism 44.

As shown in FIG. 14, the ink level detecting mechanism 44 is provided with hollow air chamber liaison units 47 and 48 connected to the liquid chamber 27-4 in the liquid storage unit 27, and a water-repellent transparent tube 49 as a transparent member for connection of the air chamber liaison units 47 and 48.

The ink in the liquid chamber 27-4 can freely enter and exit the transparent tube 49. Therefore, the same ink level as the liquid chamber 27-4 in the liquid storage unit 27 can be externally viewed.

Above and below the transparent tube 49, two light transmission sensors 53 and 54 are mounted as enclosing the transparent tube 49.

When the ink level in the liquid chamber 27-4 rises, the upper light transmission sensor 53 detects the raised ink level. When the ink level falls, the lower light transmission sensor 54 detects the dropped ink level.

The electromagnetic valve 45 shown in FIG. 13 is normally closed, and cuts off the liquid storage unit 27 from the air. When the light transmission sensor 53 or 54 receives a detection signal, the electromagnetic valve 45 is opened or closed at an instruction of the controller unit not shown in the attached drawings.

Furthermore, the crank position sensor 46 shown in FIG. 13 detects the position of the crank unit 32, and transmits a detection signal to the above-mentioned controller unit.

The controller unit confirms the position of the piston unit 31 in the piston mechanism 29 shown in FIG. 7 according to the detection signal.

Thus, the controller unit can recognize whether the piston mechanism 29 increases or decreases the predetermined in each of the liquid chambers 27-1 through 27-4 of the liquid storage unit 27.

With the configuration above, when the ink level detecting mechanism 44 recognizes that the ink level in the liquid chamber 27-4 is higher than a set level, the controller unit opens the electromagnetic valve 45 for airing when the crank position sensor 46 recognizes that the pressure in the liquid storage unit 27 decreases. In the operation, the ambient air enters the liquid storage unit 27.

By the piston unit 31 closing the electromagnetic valve 45 before starting an operation of increasing the pressure, the liquid storage unit 27 is filled with air.

Thus, the ink levels of all liquid chambers 27-1 through 27-4 fall.

When the ink level detecting mechanism 44 recognizes that the ink level in the liquid chamber 27-4 is lower than the set level, the controller unit opens the electromagnetic valve 45 for airing when the crank position sensor 46 recognizes that the pressure in the crank position sensor 46 increases. In the operation, the internal air is discharged outside.

By the piston unit 31 closing the electromagnetic valve 45 before starting the operation of decreasing the pressure, the amount of air in the liquid storage unit 27 decreases.

Thus, the ink levels of all liquid chambers 27-1 through 27-4 rise.

As described above, in the present embodiment, the ink levels of all liquid chambers can be managed by providing the ink level detecting mechanism 44 for the liquid chamber 27-4 and monitoring only the ink level of the liquid chamber 27-4.

The ink level detecting mechanism 44 can be provided not only for the liquid chamber 27-4, but also for any one liquid chamber in the liquid storage unit 27 to obtain a similar effect.

Thus, configured is a very long-life liquid pump capable of operating against the fluctuation of the amount of air inside the liquid storage unit 27 that occurs after the operation for a long period.

In the level detecting method with the above-mentioned configuration, ink is directly confirmed by a light transmission sensor. However, there is normally a problem with this detecting method that the level may not be recognized depending on the color of ink.

Especially with the light transmission sensor using infrared light, it is almost impossible to recognize the ink of magenta (red series).

However, according to the present invention, the above-mentioned problem can be solved by mounting the ink level detecting mechanism in a liquid chamber of a color that can be most easily recognized other than the magenta ink.

In addition, the above-mentioned ink level detecting mechanism is described above with reference to a level detecting operation using an inexpensive light transmission sensor as an example to propose a less expensive and high efficiency mechanism. However, a level detecting mechanism by a common current detection mechanism, magnetic detection mechanism, etc. can also be used.

Furthermore, the air chamber liaison units 47 and 48 and the water-repellent transparent tube 49 for connection of the air chamber liaison units 47 and 48 are provided in order to view the level of the ink liquid in the liquid storage unit, but the ink levels of all liquid chambers can be managed by providing a well known level sensor in at least one liquid chamber in the liquid storage unit.

Third Embodiment

In the first and second embodiments, the ink level adjusting mechanism 39 is mounted on the outlet pipe 37 having the outlet valve 36, but it can be mounted, for a similar function, on the inlet pipe 23 having the inlet valve 25.

The detailed description is given below as the third embodiment.

Figure 15:
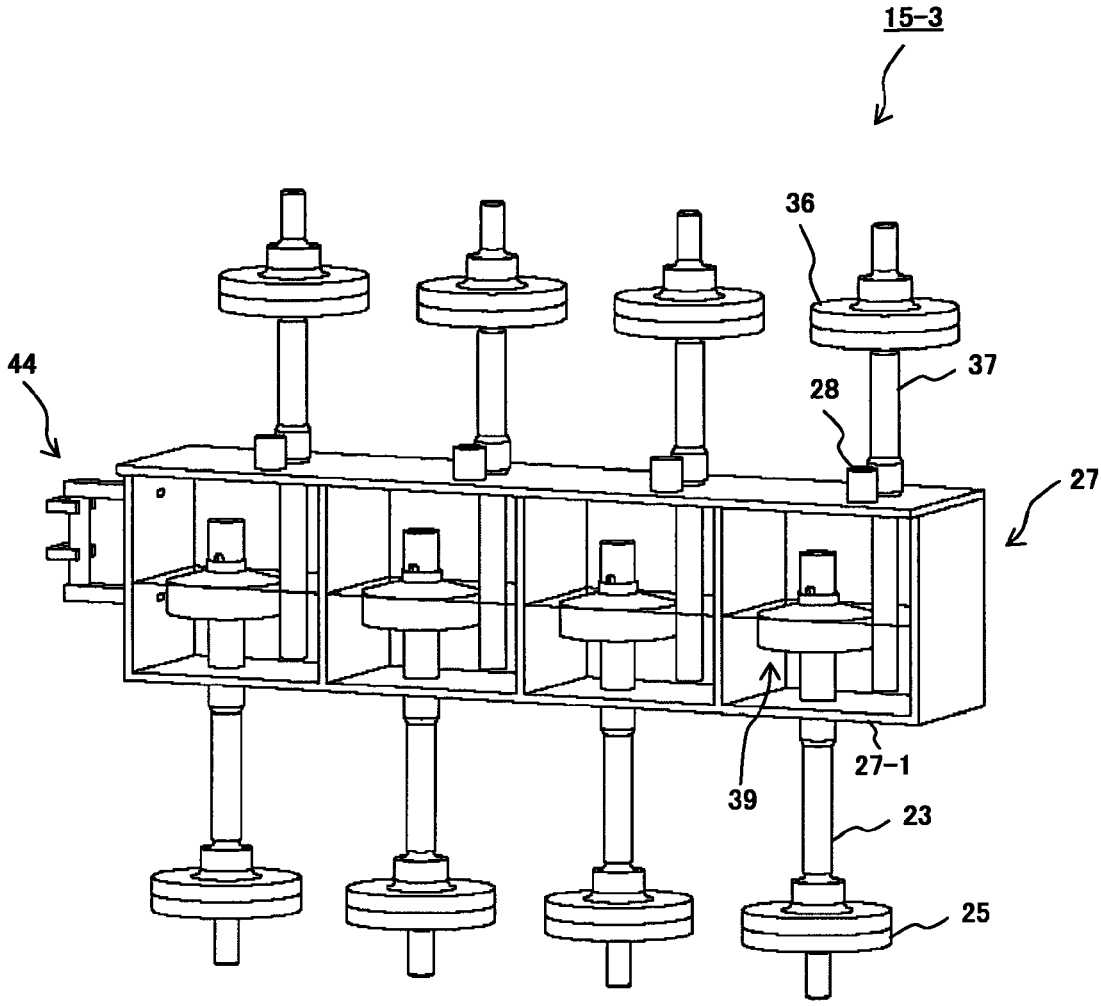
FIG. 15 is a perspective view of the configuration of the liquid pump according to the third embodiment.

FIG. 15 is a perspective view of the configuration of the liquid pump according to the third embodiment. As shown in FIG. 15, a liquid pump 15-3 according to the present embodiment is provided with the ink level adjusting mechanism 39 on the inlet pipe 23 having the inlet valve 25.

Other configurations are the same as those according to the second embodiment, and a part of the air chamber coupling member 28 and the pressure adjusting mechanism are omitted here.

Figure 16:
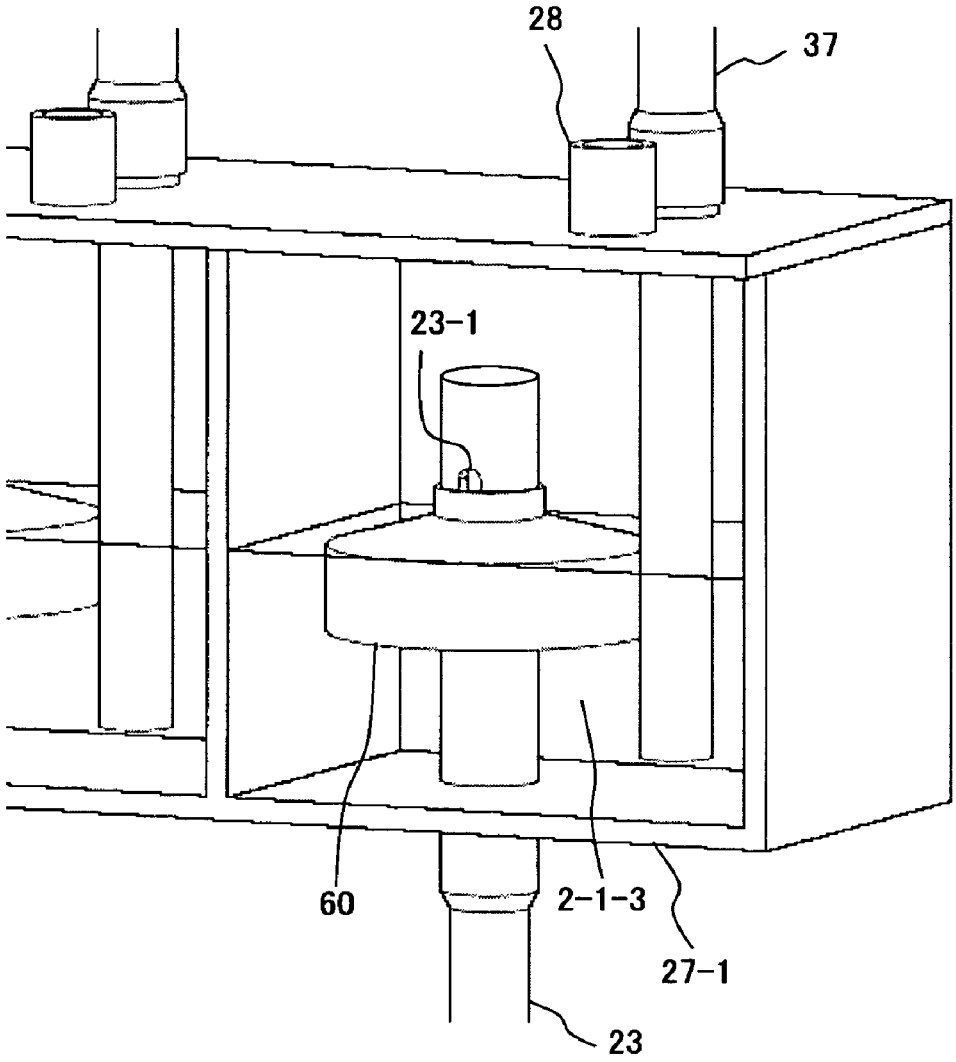
FIG. 16 is an enlarged view of the configuration of the level adjusting mechanism of the liquid pump according to the third embodiment.

FIG. 16 is an enlarged view of the configuration of the ink level adjusting mechanism 39 of the liquid pump 15-3 according to the third embodiment.

As shown in FIG. 16, the ink level adjusting mechanism 39 is configured by a float 60 that can float as the level following member 38 on a liquid, and an ink inlet 23-1 provided as the ink liquid intake on the side of the inlet pipe 23.

The upper end portion of the inlet pipe 23 is closed. The float 60 is engaged on the inlet pipe 23 such that the float can slide on the pipe.

The ink inlet 23-1 changes the open area of the ink inlet 23-1 by the movement of the float 60 moving up and down in cooperation with the ink level.

That is, when the ink level is high, the float 60 rises, and the open area of the ink inlet 23-1 is narrowed, and the amount of incoming ink from the lower portion sub-ink-tank decreases. When the ink level is low, the float 60 falls, and the open area of the ink inlet 23-1 is expanded, and the amount of incoming ink from the lower portion sub-ink-tank increases.

With the configuration, the ink passes from above the float 60. Therefore, a taper is formed on the top surface of the float 60 as shown in FIG. 16 so that the ink cannot fixed and trapped on the float 60.

The above-mentioned configuration designed for all liquid chambers 27-1 through 27-4 in the liquid storage unit 27, thereby allowing the ink level to be equal in all liquid chambers 27-1 through 27-4.

Thus, the liquid pump 15-3 can continue the operation as a pump for a long time.

Fourth Embodiment

Figure 17:
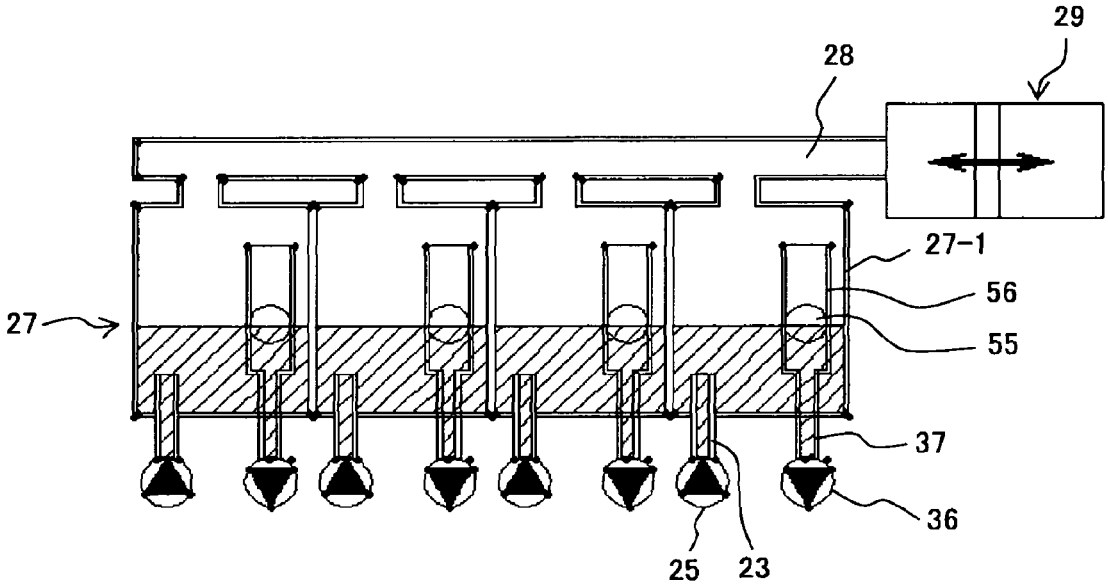
FIG. 17 shows the configuration of the level adjusting mechanism according to the fourth embodiment.

FIG. 17 shows the configuration of the level adjusting mechanism according to the fourth embodiment. In FIG. 17, the configurations and the functions that are the same, although different in shape, as those shown in FIGS. 4 through 16 are assigned the same reference numerals as FIGS. 4 through 16.

In the present embodiment, although not directly related to the level adjusting mechanism, the outlet pipe 37 shown in the first through third embodiments is connected above the liquid storage unit 27, but it is connected below the liquid storage unit 27.

In FIG. 17, a cylindrical guide unit 56 is formed at the upper end portion of the outlet pipe 37, and is put in the ink liquid of the liquid chamber.

A slit is formed in the vertical direction on the side surface of the cylindrical guide unit 56 such that the ink liquid in the liquid chamber can freely enter and exit the guide unit 56.

Thus, the ink levels inside and outside the cylindrical guide unit 56 are maintained constantly at the same level.

A float 55 as the level following member supported in the cylinder of the guide unit 56 is configured as a sphere. The float 55 moves up and down in cooperation with the ink level in the cylinder of the 56, that is, the level in the liquid chamber.

The guide unit 56 is a guide for protecting the float 55 against the displacement from the locus of the up and down movement in cooperation with the ink level. That is, the guide unit 56 is provided to regulate the direction of the movement of the float 55.

Other configurations are the same as in the first embodiment.

With the above-mentioned configuration, when the spherical float 55 drops by the drop of the ink level, the upper end of the outlet pipe 37 as the ink liquid intake is substantially closed.

That is, when the spherical float 55 drops by the drop of the ink level, the amount of ink conveyed to the upper portion sub-ink-tank 5 decreases.

In addition, when the spherical float 55 rises with the rising ink level, the upper end of the outlet pipe 37 is not closed by the float 55. Therefore, the amount of ink conveyed to the upper portion sub-ink-tank 5 increases. By designing the configuration for all liquid chambers 27-1 through 27-4 in the liquid storage unit 27, the ink level is allowed to be equal in all liquid chambers 27-1 through 27-4.

Fifth Embodiment

Figure 18:
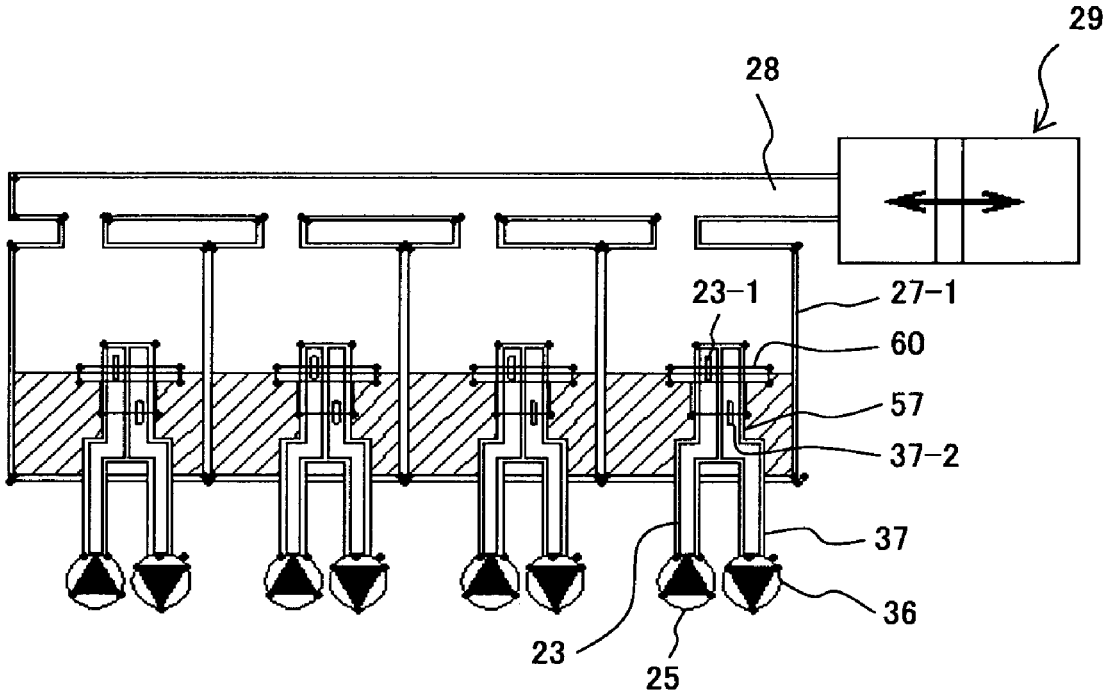
FIG. 18 shows the configuration of the level adjusting mechanism according to the fifth embodiment.

FIG. 18 shows the configuration of the level adjusting mechanism according to the fifth embodiment. In FIG. 18, the configurations and the functions that are the same, although different in shape, as those shown in FIGS. 4 through 16 are assigned the same reference numerals as FIGS. 4 through 16.

In the present embodiment, although not directly related to the level adjusting mechanism, the outlet pipe 37 shown in the first through third embodiments is connected above the liquid storage unit 27, but it is connected below the liquid storage unit 27.

As shown in FIG. 18, the upper ends of the inlet pipe 23 and the outlet pipe 37 are formed as one unit into a vertical division cylinder 57.

The float 60 similar to those shown in FIGS. 16 and 17 is engaged in the vertical division cylinder 57 such that the float can slide on the vertical division cylinder.

The vertical division cylinder 57 is vertically divided into two rooms. One of the two rooms corresponds to the inlet pipe 23 for leading ink into the liquid chamber 27-1.

The other of the two rooms corresponds to the outlet pipe 37 for conveying an ink liquid from the liquid chamber 27-1.

The ink outlet 37-2 for discharging the ink to the tube 24 is formed in the room corresponding to the outlet pipe 37. The ink inlet 23-1 for introducing ink from the tube 16 is formed in the room corresponding to the inlet pipe 23.

That is, the level adjusting mechanism according to the present embodiment is a combination of the function of the level adjusting mechanism according to the first embodiment and the function of the according to the third embodiment.

The functions similar to those described with reference to the first and third embodiments can be simultaneously obtained by the float 60 expanding and narrowing the open areas of the ink outlet 37-2 and the ink inlet 23-1 formed in the two rooms of the vertical division cylinder 57.

That is, when the ink level falls, the float 60 follows it and drops, the open area of the ink outlet 37-2 is reduced, and the amount of discharge of the ink liquid to the upper portion sub-ink-tank decreases.

Simultaneously, the open area of the ink inlet 23-1 is expanded, thereby increasing the amount of incoming ink liquid from the lower portion sub-ink-tank.

On the other hand, when the ink level rises, the float 60 follows it and is raised, and the open area of the ink outlet 37-2 is expanded, thereby increasing the amount of discharge of the ink liquid to the upper portion sub-ink-tank.

Simultaneously, the open area of the ink inlet 23-1 is reduced, thereby decreasing the amount of incoming ink liquid from the lower portion sub-ink-tank.

Thus, the volume of the liquid chamber, that is, the entire volume of the liquid storage unit 27, can be reduced (smaller).

The present invention has been described with reference to the liquid pump for simultaneously conveying plural types of ink liquids by one pressure adjusting mechanism, but the liquids are not limited to the ink liquids, and the present invention can be applied to various types of liquids.

In addition to the above-mentioned embodiments, the present invention can be varied and available within the scope of the gist of the invention in each embodying case.

What is claimed is:

1. A liquid pump, comprising: a liquid storage unit having liquid chambers for trapping at least two types of liquids, wherein each liquid chamber corresponds to one of said at least two types of liquids; a coupling member which connects to each liquid chamber of the liquid storage unit; a pressure adjusting mechanism, connected to the coupling member, for alternately switching an internalc pressure of each liquid chamber between a negative pressure and a positive pressure; an inlet pipe having an inlet valve capable of passing liquid only in one direction, for passing the liquid to one of the liquid chambers; an outlet pipe having an outlet valve capable of passing the liquid only in one direction, for passing the liquid from said one of the liquid chambers; and a pass resistance variable mechanism which adjusts an amount of the liquid trapped in said one of the liquid chambers depending on a level of the liquid in said one of the liquid chambers, wherein the pass resistance variable mechanism comprises a level following member and an ink liquid intake, and wherein the level following member follows the level of the liquid in said one of the liquid chambers and then moves, thereby varying an open area of the ink liquid intake.

2. An inkjet printer, comprising:

at least two ink tanks containing ink;

an image recording unit which records an image by discharging the ink onto a recording medium; and a pump which supplies the ink in the ink tanks to the image recording unit, wherein the pump includes:

a liquid storage unit having liquid chambers corresponding to the respective ink tanks;

a coupling member which connects to each liquid chamber of the liquid storage unit;

a pressure adjusting mechanism, connected to the coupling member, for alternately switching an internal pressure of each liquid chamber between a negative pressure and a positive pressure;

an inlet pipe having an inlet valve for passing the ink in one of the ink tanks to a corresponding one of the liquid chambers;

an outlet pipe having an outlet valve for passing the ink in said one of the liquid chambers to the image recording unit; and a pass resistance variable mechanism which adjusts an amount of the ink trapped in said one of the liquid chambers depending on a level of the ink in said one of the liquid chambers, wherein the pass resistance variable mechanism comprises a level following member and an ink liquid intake, and wherein the level following member follows the level of the ink in said one of the liquid chambers and then moves, thereby varying an open area of the ink liquid intake.

3. The inkjet printer according to claim 2, wherein the inlet valve passes the ink to said one of the liquid chambers when the pressure adjusting mechanism allows the internal pressure of the liquid chamber to be the negative pressure.

4. The inkjet printer according to claim 2, wherein the outlet valve passes the ink from said one of the liquid chambers when the pressure adjusting mechanism allows the internal pressure of the liquid chamber to be the positive pressure.

5. The inkjet printer according to claim 2, wherein:

the level following member is arranged on the outlet pipe such that the member can slide on the outlet pipe, the ink liquid intake is formed on the outlet pipe, and the level following member increases the open area of the ink liquid intake, thereby adjusting an amount of ink passing from said one of the liquid chambers to the outlet valve, when the ink in the liquid chamber increases.

6. The inkjet printer according to claim 2, wherein:

the level following member is arranged on the inlet pipe such that the member can slide on the inlet pipe, the ink liquid intake is formed on the inlet pipe, and the level following member decreases the open area of the ink liquid intake, thereby adjusting an amount of incoming ink from the inlet valve to said one of the liquid chambers, when the ink in the liquid chamber increases.

7. The inkjet printer according to claim 5, wherein the ink liquid intake is formed on a side of the outlet pipe.

8. The inkjet printer according to claim 6, wherein the ink liquid intake is formed on a side of the inlet pipe.

9. The inkjet printer according to claim 2, wherein:

the level following member comprises a float, a float stopper, a cover unit, and a rotation arm, the ink liquid intake is formed on the outlet pipe, when the ink in said one of the liquid chambers increases, the float touches the float stopper and the cover unit opens the ink liquid intake, and when the ink in the liquid chamber decreases, the float moves to follow the level of the ink in the liquid chamber, thereby rotating the rotation arm and causing the cover unit to close the ink liquid intake.

10. The inkjet printer according to claim 9, wherein the ink liquid intake is formed on an end portion of the outlet pipe, and a groove is formed at the end portion of the outlet pipe.

11. The inkjet printer according to claim 2, wherein:

the ink liquid intake and a guide unit having a slit for regulating a moving direction of the level following member are formed on the outlet pipe, the level following member is arranged in the guide unit, the level following member opens the ink liquid intake when the ink of said one of the liquid chambers increases, and when the ink of the liquid chamber decreases, the level following member moves along the guide unit by following the level of the ink in the liquid chamber, thereby closing the ink liquid intake.

12. The inkjet printer according to claim 2, wherein the pump further comprises, in at least one of the liquid chambers of the liquid storage unit, a level detecting mechanism for detecting a level of the ink in said one of the liquid chambers.

13. The inkjet printer according to claim 12, wherein the pump further comprises:

a pressure detection unit for detecting a pressure in said one of the liquid chambers, as set by the pressure adjusting mechanism; and an airing mechanism for airing the liquid chamber according to a detection signal from the level detecting mechanism and the pressure detection unit.

14. The inkjet printer according to claim 13, wherein when the level detecting mechanism detects that the level of the ink in said one of the liquid chambers rises higher than a predetermined level, the airing mechanism is opened when the pressure adjusting mechanism places the liquid chamber in the negative pressure according to the pressure detection unit, and the airing mechanism is closed when the pressure adjusting mechanism places the liquid chamber in the positive pressure.

15. The inkjet printer according to claim 13, wherein when the level detecting mechanism detects that the level of the ink in said one of the liquid chambers falls lower than a predetermined level, the airing mechanism is opened when the pressure adjusting mechanism places the liquid chamber in the positive pressure according to the pressure detection unit, and the airing mechanism is closed when the pressure adjusting mechanism places the liquid chamber in the negative pressure.

16. The inkjet printer according to claim 12, wherein the level detecting mechanism detects the level of the ink using a transparent member for connection to said one of the liquid chambers and a transmission sensor using infrared light.

17. The inkjet printer according to claim 16, wherein the level detecting mechanism is mounted in said one of the liquid chambers for trapping ink other than a red series.

18. The inkjet printer according to claim 2, further comprising:

an upper tank temporarily trapping ink passed from a corresponding one of the ink tanks, and supplying the trapped ink to the image recording unit; and a lower tank collecting the ink not discharged by the image recording unit, and temporarily trapping the collected ink, wherein the pump returns the ink in the lower tank to the upper tank, and circulates the ink.

* * * * *